US007649459B2

(12) United States Patent
Hewitt et al.

(10) Patent No.: US 7,649,459 B2
(45) Date of Patent: Jan. 19, 2010

(54) SHIPPING CONTAINER SECURITY UNIT QUICK MOUNT DEVICE

(75) Inventors: Gordon S. Hewitt, Trabuco Canyon, CA (US); Guy E. Zierten, Huntington Beach, CA (US); Peter S. Lauenstein, La Canada, CA (US)

(73) Assignee: The Boeing Company, Chicago, IL (US)

( * ) Notice: Subject to any disclaimer, the term of this patent is extended or adjusted under 35 U.S.C. 154(b) by 443 days.

(21) Appl. No.: 11/263,315

(22) Filed: Oct. 31, 2005

(65) Prior Publication Data

US 2007/0075076 A1 Apr. 5, 2007

Related U.S. Application Data

(63) Continuation-in-part of application No. 11/240,994, filed on Sep. 30, 2005.

(51) Int. Cl.
*G08B 13/14* (2006.01)
*G08B 13/08* (2006.01)
*A47F 5/08* (2006.01)

(52) U.S. Cl. ..... 340/572.1; 340/549; 211/89.01

(58) Field of Classification Search ... 340/572.1–572.8, 340/549, 550, 693.11, 539.22, 545.1–545.7, 340/539.31; 361/600; 248/200, 221.11; 211/86.01, 189

See application file for complete search history.

(56) References Cited

U.S. PATENT DOCUMENTS

| | | | | |
|---|---|---|---|---|
| 6,729,485 | B2 * | 5/2004 | Ehrgott | 211/189 |
| 6,753,775 | B2 * | 6/2004 | Auerbach et al. | 340/539.22 |
| 7,315,246 | B2 * | 1/2008 | Rajapakse et al. | 340/549 |
| 7,317,387 | B1 * | 1/2008 | Cova et al. | 340/539.1 |
| 7,538,672 | B2 * | 5/2009 | Lockyer et al. | 340/545.6 |
| 2007/0075074 | A1 * | 4/2007 | Jaeger et al. | 220/1.5 |
| 2007/0247800 | A1 * | 10/2007 | Smith et al. | 361/683 |
| 2009/0102650 | A1 * | 4/2009 | Diener et al. | 340/542 |

* cited by examiner

*Primary Examiner*—Benjamin C Lee
*Assistant Examiner*—Sigmund Tang
(74) *Attorney, Agent, or Firm*—Gates & Cooper LLP

(57) ABSTRACT

Methods and apparatuses for attaching electronics equipment to a cargo container are disclosed. A device in accordance with the present invention comprises a first portion, comprising a wireguide, a second portion, coupled to the first portion at an edge of the first portion, at an approximate right angle to the first portion, the wireguide continuing to at least a part of the second portion, and a third portion, coupled to the second portion, the third portion being approximately perpendicular to the first portion and approximately parallel to the second portion, wherein the second portion and the third portion are designed to accommodate a door flange of a cargo container to attach the mounting device to the cargo container.

8 Claims, 3 Drawing Sheets

SHIPPING CONTAINER SECURITY UNIT QUICK MOUNT DEVICE

CROSS-REFERENCE TO RELATED APPLICATIONS

This application is a continuation-in-part of U.S. patent application Ser. No. 11/240,994, entitled, "SHIPPING CONTAINER SECURITY UNIT QUICK MOUNT DEVICE," by Randy L. Jaeger et al., filed on Sep. 30, 2005, the contents of which are incorporated by reference herein.

BACKGROUND OF THE INVENTION

1. Field of the Invention

The present invention relates generally to shipping containers, and in particular, to a shipping container security unit quick mount device.

2. Description of the Related Art

Shipping containers are used to transport goods all over the world. Many shipping containers are monitored to maintain a log of their whereabouts, as well as to monitor their estimated time of delivery to a given port or destination. There are over five million shipping containers in use today, and they typically transport over 500 billion dollars worth of goods into the United States on an annual basis.

In recent years, monitoring the flow of goods in these shipping containers has become more important. Since many goods are of higher value, the goods are under a larger threat of pilferage. Further, shipping containers could easily be tampered with to contain high explosives, or be used as a terrorist entry point into harbors and/or ports in the United States. The use of shipping containers for such purposes has been studied extensively by the Department of Homeland Security.

The current method of attaching tracking and/or monitoring devices is through the use of tape or other adhesives. The tape or adhesive material is used to affix the electronics boxes to the walls or ceiling of the container. The current method is very time consuming. Further, since this is typically done before the container is loaded and removed after the container is unloaded, additional loading time and unloading time is required for each container. Currently, using the tape and adhesive method, this attachment process for the electronic devices takes over an hour per container, to ensure that the electronics and associated wires that attach to an externally mounted antenna are not compromised by the container or the cargo within the shipping container.

The current method must also take into account that the cargo to be shipped in a given shipping container must not interfere with, damage, or otherwise contact the electronic devices. As such, the electronics devices and associated wires must be adhered to the container with excess tape and/or adhesive to ensure that any slight jarring of the container or of the electronic devices does not remove the electronic devices from their adhered positions.

As such, it can be seen that there is a need in the art for a device that makes installation of electronics devices on shipping containers less time consuming. It can also be seen that there is a need in the art for a device that makes installation of electronic devices on shipping containers easier and more efficient.

SUMMARY OF THE INVENTION

To minimize the limitations in the prior art, and to minimize other limitations that will become apparent upon reading and understanding the present specification, the present invention discloses methods and apparatuses for attaching electronics equipment to a cargo container. A device in accordance with the present invention comprises a first portion, comprising a wireguide, a second portion, coupled to the first portion at an edge of the first portion, at an approximate right angle to the first portion, the wireguide continuing to at least a part of the second portion, and a third portion, coupled to the second portion, the third portion being approximately perpendicular to the first portion and approximately parallel to the second portion, wherein the second portion and the third portion are designed to accommodate a door flange of a cargo container to attach the mounting device to the cargo container.

Such a device further optionally includes a bracket, coupled to the first portion of the mounting device, wherein the electronics equipment is attached to the bracket, the second portion, upon attaching the hanger to the cargo container, moving a door seal from between the second portion and the third portion, a wire from the electronics equipment being placed in the wireguide, at least the second portion protecting the wire from being damaged by a door of the cargo container, the bracket being attached to the cargo container, the electronics equipment being a security unit or a tracking unit, and a shelf, coupled to the bracket, for aiding in supporting the electronics equipment.

An alternative embodiment of the present invention comprises a first surface including at least one wireguide and at least one keyway, the first surface designed to accept mounting of the electronic device, a second surface, coupled to the first surface, wherein the second surface is designed to fit between a first door and a door flange of a second door on a cargo container, and a third surface, coupled to the second surface such that the third surface is substantially perpendicular to the first surface, wherein the second surface and the third surface attach the mounting device to the shipping container.

Such a device further optionally includes a bracket is mounted between the electronic device and the mounting device using the at least one keyway, the second side also including the at least one wireguide, the second side protecting a wire connected to the electronic device, and the electronics equipment being a security unit or a tracking unit.

Other features and advantages are inherent in the system and method claimed and disclosed or will become apparent to those skilled in the art from the following detailed description and its accompanying drawings.

BRIEF DESCRIPTION OF THE DRAWINGS

Referring now to the drawings in which like reference numbers represent corresponding parts throughout.

DETAILED DESCRIPTION OF THE PREFERRED EMBODIMENTS

In the following description, reference is made to the accompanying drawings which form a part hereof, and which is shown, by way of illustration, several embodiments of the present invention. It is understood that other embodiments may be utilized and structural changes may be made without departing from the scope of the present invention.

Door Hanger

Figure 1:
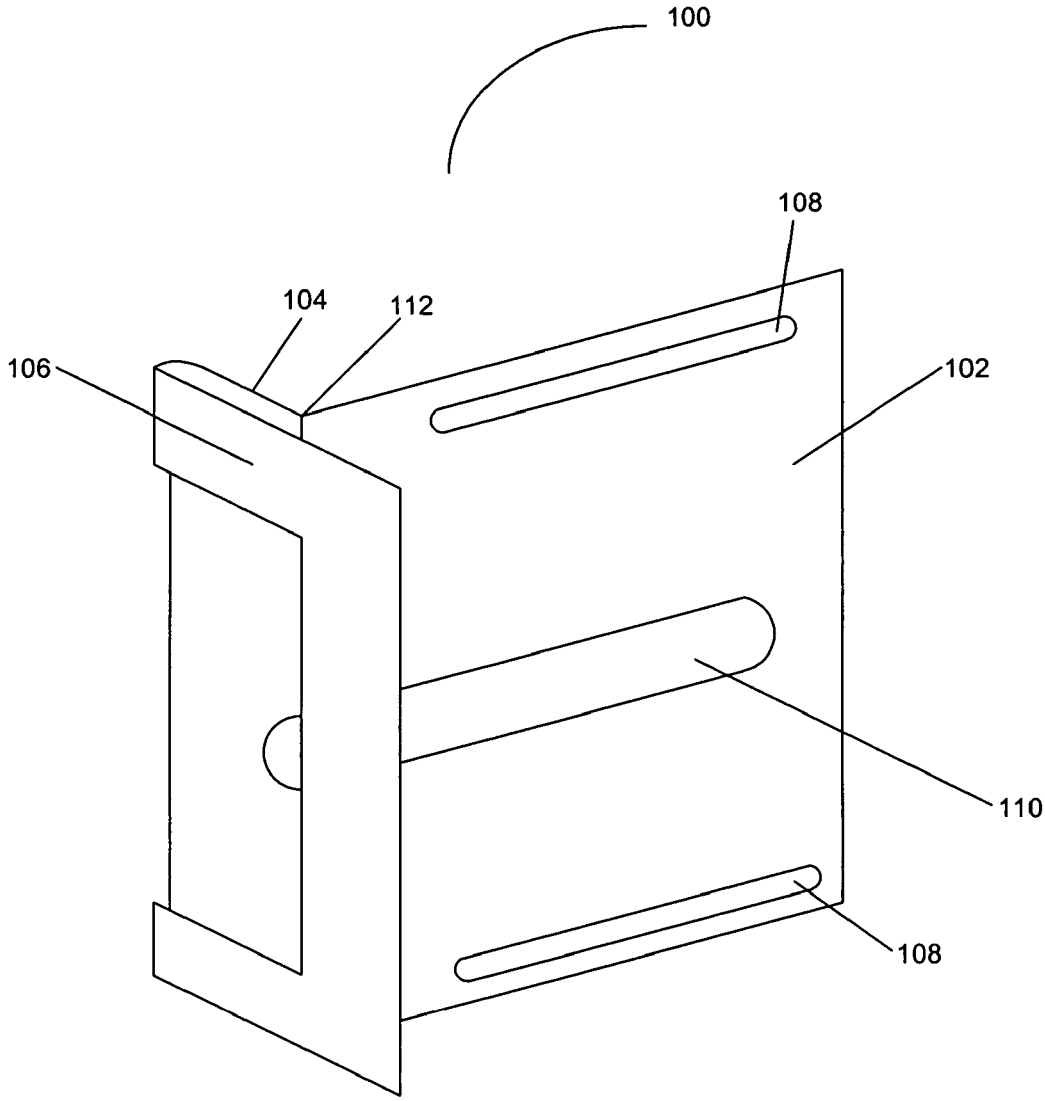
FIG. 1 illustrates a perspective view of a first embodiment of the present invention.

FIG. 1 illustrates a perspective view of a first embodiment of the present invention.

FIG. 1 illustrates hanger 100 with first portion 102 (also referred to as first surface 102), second portion 104 (second surface 104), and third portion 106 (third surface 106). Typically, first portion 102, second portion 104, and third portion 106 are made from a single piece of material that is shaped as shown in FIG. 1, but can be made from several pieces of material without departing from the scope of the present invention. For example, first portion 102 may be made of a plastic or other non-conductive material if desired, to prevent anything mounted on first portion 102 from being electrically connected to the cargo container hanger 100 is attached to. Further, first portion 102, second portion 104, and third portion 106 can be bolted together rather than being formed as a single piece.

First portion 102 is typically the mounting surface for electronics equipment or container tracking device. On first portion 102, keyways 108 and wireguide 110 are present. Wireguide 110 continues through to second portion 104. Keyways 108 provide a through hole for bolts to attach electronics to hanger 100, and wireguide 110 provides an opening for wires that must travel between the inside of the cargo container and the outside of the cargo container such that the wires are not damaged or severed by the door of the cargo container. Wireguide 110 provides an access point through second portion 104 such that the wires are then run along the surface of the door flange, and third portion 106 protects the wires from being crushed or severed by the door flange or other cargo container items.

The size of first portion 102 is large enough to mount typical electronics equipment. Typically, this is approximately 10 inches across and 10 inches high, but can be other sizes if desired.

Second portion 104 is attached to first portion 102 along line 112. The angle of attachment between second portion 104 and first portion 102 is substantially a right angle. The length of second portion 104 allows for hangar 100 to be mounted to a door of a cargo container, specifically the flange on the door that provides a seal on the cargo container.

Third portion 106 acts as a barrier to movement of the hanger 100 on the cargo container. As hanger 100 is placed on the cargo container, third portion 106 moves the rubber gasket of the door of the cargo container out of the way so that the door of the cargo container will close easily.

Figure 2:
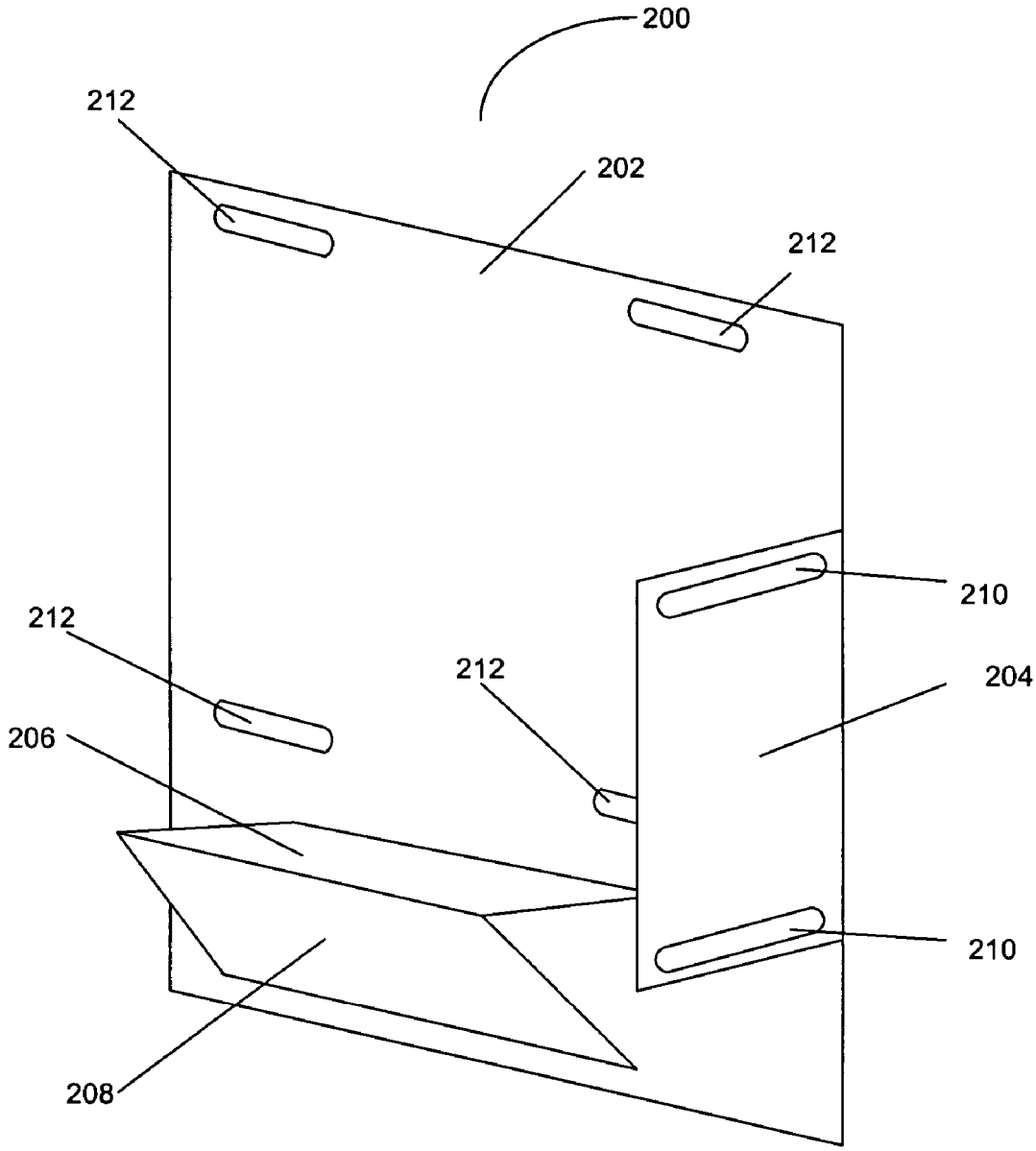
FIG. 2 illustrates an attaching plate in accordance with the present invention.

FIG. 2 illustrates an attaching plate in accordance with the present invention. Bracket 200 comprises first portion 202, bracket 204, and shelf 206, with support 208. Bracket 204 further comprises keyways 210, which are used to attach bracket 200 to hanger 100, through the use of nuts and bolts or other attachment devices. Bracket 204 can have self-contained bolts, or self-contained nuts, such that bracket 200 and hanger 100 can be attached through the use of such attachment hardware rather than having keyways 210 if desired.

Shelf 206, supported by support 208, holds up the electronics units that are to be mounted in the cargo container. Keyways 212 can be used to affix or otherwise attach electronics to bracket 200, or, if desired, keyways 212 can be used to affix or otherwise attach bracket 200 to the wall of the cargo container.

Typically, bracket 200 and hanger 100 are used in combination to mount electronics onto a cargo container, however, if the electronics is light enough, electronics can be mounted directly to hanger 100 if desired.

Operation of Hanger

Figure 3:
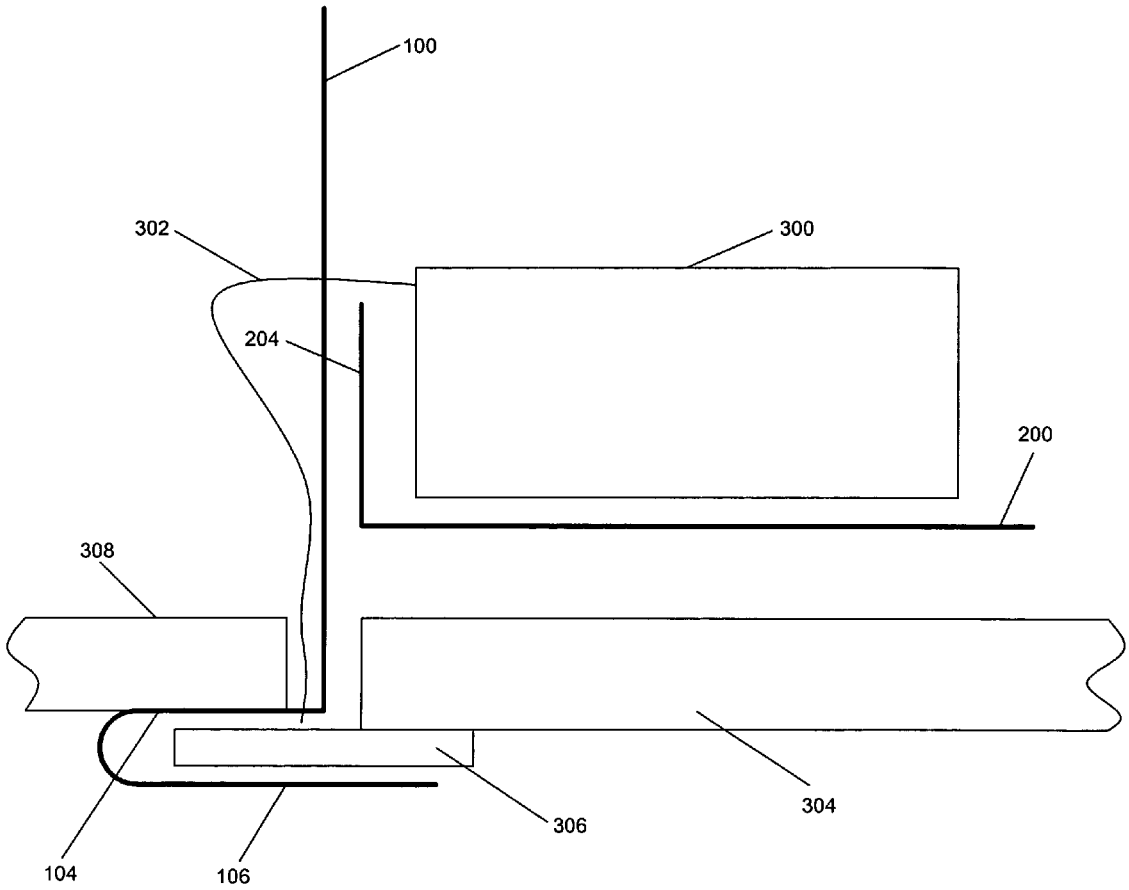
FIG. 3 illustrates a top view of an electronics package mounted in the brackets of the present invention.

FIG. 3 illustrates a top view of an electronics package mounted in the brackets of the present invention.

Electronics package 300 with wires 302 is mounted to bracket 200, which is coupled to hanger 100. Bracket 200 can be mounted to door 304 if desired. Wires 302 are run along hanger 100, in wireguide 110, through second portion 104 and along door flange 306, such that when door 304 with door flange 306 closes against door 308 of the cargo container, wires 302 are not crushed or severed by door 304 or door 308. Second portion 104 and third portion 106 protect wires 302 when doors 304 and 308 are closed, such that wires 302 can perform their intended function with respect to electronics 300. Typically, wires 302 are antenna wires, but can be other wires without departing from the scope of the present invention.

Although hanger 100 and bracket 200 are shown as a separate piece from electronics 300, it is within the scope of the present invention to make electronics 300 such that hanger 100 or bracket 200 is integral to electronics 300, such that a separate mounting of electronics 300 to bracket 200 or hanger 100 is not necessary, and thus electronics 300 would be able to hang on door 304 directly if desired.

Electronics 300 is typically a security unit or a tracking unit, where electronics 300 records data or determines geoposition of the cargo container. For example, and not by way of limitation, electronics 300 can be a Global Positioning System (GPS) receiver, as well as a datalogger that records when the geoposition of the cargo container was recorded. Further, electronics 300 can be a device to determine when the door 304 of the cargo container has been opened, where the cargo container was when the door 304 was opened, etc. This data can be transmitted from electronics 300 such that the information can be stored, tracked, and analyzed remotely from the cargo container if desired.

Conclusion

This concludes the description of the preferred embodiment of the invention. In summary, embodiments of the invention provide methods and apparatuses for attaching electronics equipment to a cargo container. A device in accordance with the present invention comprises a first portion, comprising a wireguide, a second portion, coupled to the first portion at an edge of the first portion, at an approximate right angle to the first portion, the wireguide continuing to at least a part of the second portion, and a third portion, coupled to the second portion, the third portion being approximately perpendicular to the first portion and approximately parallel to the second portion, wherein the second portion and the third portion are designed to accommodate a door flange of a cargo container to attach the mounting device to the cargo container.

Such a device further optionally includes a bracket, coupled to the first portion of the mounting device, wherein the electronics equipment is attached to the bracket, the second portion, upon attaching the hanger to the cargo container, moving a door seal from between the second portion and the third portion, a wire from the electronics equipment being placed in the wireguide, at least the second portion protecting the wire from being damaged by a door of the cargo container, the bracket being attached to the cargo container, the electronics equipment being a security unit or a tracking unit, and a shelf, coupled to the bracket, for aiding in supporting the electronics equipment.

An alternative embodiment of the present invention comprises a first surface including at least one wireguide and at least one keyway, the first surface designed to accept mounting of the electronic device, a second surface, coupled to the first surface, wherein the second surface is designed to fit between a first door and a door flange of a second door on a cargo container, and a third surface, coupled to the second surface such that the third surface is substantially perpendicular to the first surface, wherein the second surface and the third surface attach the mounting device to the shipping container.

Such a device further optionally includes a bracket is mounted between the electronic device and the mounting device using the at least one keyway, the second side also including the at least one wireguide, the second side protecting a wire connected to the electronic device, and the electronics equipment being a security unit or a tracking unit.

The foregoing description of the preferred embodiment of the invention has been presented for the purposes of illustration and description. It is not intended to be exhaustive or to limit the invention to the precise form disclosed. Many modifications and variations are possible in light of the above teaching. It is intended that the scope of the invention be limited not by this detailed description, but rather by the claims appended hereto and the equivalents thereof.

What is claimed is:

1. A mounting device for attaching electronics equipment to a cargo container, comprising:

a first portion, comprising a wireguide;

a second portion, coupled to the first portion at an edge of the first portion, at an approximate right angle to the first portion, the wireguide continuing to at least a part of the second portion;

a third portion, coupled to the second portion, the third portion being approximately perpendicular to the first portion and approximately parallel to the second portion, wherein the second portion and the third portion are designed to wrap around a door flange of a cargo container to attach the mounting device to the cargo container and wherein the wireguide comprises a continuous opening between the first portion and the second portion therein providing an access point through the second portion to an exterior of the cargo container and protects a wire from damage from the door flange, wherein the wire is placed in the wireguide and connected to the electronics equipment; and a bracket, coupled to the first portion of the mounting device, wherein the electronics equipment is one of a tracking unit and a security unit that is attached to the bracket.

2. The mounting device of claim 1, wherein the second portion, upon attaching the mounting device to the cargo container, moves a door seal from between the second portion and the third portion.

3. The mounting device of claim 1, wherein at least the second portion protects the wire from being damaged by a door of the cargo container.

4. The mounting device of claim 3, wherein the bracket is attached to the cargo container.

5. The mounting device of claim 1, further comprising a shelf, coupled to the bracket, for aiding in supporting the electronics equipment.

6. A mounting device for mounting an electronic device inside of a shipping container, comprising:

a first surface including at least one wireguide and at least one keyway, the first surface designed to accept mounting of the electronic device;

a second surface, coupled to the first surface, wherein the second surface is designed to fit between a first door and a door flange of a second door on a cargo container; and a third surface, coupled to the second surface such that the third surface is substantially perpendicular to the first surface and substantially parallel to the second surface, wherein the second surface and the third surface attach the mounting device to the shipping container and wherein the wireguide comprises a continuous opening between the first surface and the second surface therein providing an access point through the second surface to an exterior of the cargo container and protects a wire from damage from the door flange, wherein the wire is placed in the wireguide and connected to the electronic device; and a bracket, mounted between the electronic device and the mounting device using the at least one keyway, wherein the electronic device is one of a tracking unit and a security unit that is attached to the bracket.

7. The mounting device of claim 6, wherein the second surface also includes the at least one wireguide.

8. The mounting device of claim 7, wherein at least the second surface protects a wire connected to the electronic device.

* * * * *